US008341796B1

(12) United States Patent
Rhee et al.

(10) Patent No.: US 8,341,796 B1
(45) Date of Patent: Jan. 1, 2013

(54) PERSONAL HYGIENE DEVICE WITH EXTENDING HANDLE AND DISPOSABLE WIPE

(76) Inventors: Kyung Tai Rhee, LittleSilver, NJ (US); Bongshin Rhee, Little Silver, NJ (US); Audrey C. Rhee, Little Silver, NJ (US); Michele K. Rhee, Little Silver, NJ (US)

( * ) Notice: Subject to any disclaimer, the term of this patent is extended or adjusted under 35 U.S.C. 154(b) by 563 days.

(21) Appl. No.: 12/603,640

(22) Filed: Oct. 22, 2009

(51) Int. Cl.
*A47K 7/08* (2006.01)

(52) U.S. Cl. ..... 15/210.1; 15/231

(58) Field of Classification Search ..... 15/104.94, 15/210.1, 231
See application file for complete search history.

(56) References Cited

U.S. PATENT DOCUMENTS 2,149,061 A * 2/1939 Martelli ..... 15/210.1
5,067,194 A * 11/1991 Rosenfeld et al. ..... 15/144.2
5,875,512 A 3/1999 Lathan
6,158,077 A * 12/2000 Wenger et al. ..... 15/210.1
6,269,516 B1 * 8/2001 Saatjian et al. ..... 15/210.1
7,698,773 B2 * 4/2010 Sotelo ..... 15/210.1

* cited by examiner

*Primary Examiner* — Randall Chin
(74) *Attorney, Agent, or Firm* — LaMorete & Associates, P.C

(57) ABSTRACT

A device for wiping a section of the human body surrounding the anus having a contoured body that is shaped to mimic the contours of the anatomy between the anus and groin within the natural depression. A ridge is formed on the contoured body. The ridge starts proximate a forward edge and progresses toward a rear edge. The ridge follows an ascending slope to an apex. Additionally, sloped side surfaces ascend from the side edges toward the ridge. A handle extends laterally from the contoured body. The handle enables the contoured body to be pulled laterally across the body. The contoured body is covered with a disposable wipe. As the wipe moves across the body, it wipes clean the contacted area. The wipe is then removed and thrown away.

12 Claims, 3 Drawing Sheets

PERSONAL HYGIENE DEVICE WITH EXTENDING HANDLE AND DISPOSABLE WIPE

BACKGROUND OF THE INVENTION

1. Field of the Invention

In general, the present invention relates to sanitary wipes of the kind used by people to wipe their posteriors. More particularly, the present invention relates to devices that position a sanitary wipe at the end of an extension handle.

2. Prior Art Description

It is important for the health of the body that a person properly wipe after having a bowel movement. If a person does not wipe properly, residual fecal matter can cause the skin to rash. If the rash is not treated, bacteria from the fecal matter can rapidly cause the rash to become infected.

Most people are taught proper wiping hygiene as a child. However, the physical action of wiping does require a certain degree of dexterity that many people do not have. For example, people with arthritis, muscle injuries, bone injuries and the obese are only a few groups that cannot wipe in the traditional manner.

In the prior art, there are many devices that have been developed to assist a person in the act of wiping. Many of these prior art devices have elongated handles that assist people to properly reach the areas of their bodies that require wiping. Such devices typically have small heads that are covered with a disposable wipe. A handle extends from the head so that the head can be manually manipulated by grasping and moving the handle. Such prior art devices are exemplified by U.S. Pat. No. 5,875,512 to Lathan, entitled Personal Hygiene Device, and U.S. Pat. No. 5,067,194 to Rosenfeld, entitled Sanitary Device.

The problem most associated with such prior art devices is that the head of the device that contacts the body is small. Furthermore, the contact head has a shape that is dissimilar from the contoured shape of the surfaces it is wiping. The result is that such prior art devices do not wipe efficiently and require complex manipulations to create a clean wipe. In understanding that people who use a handled wipe have heath issues that cause immobility, providing a wipe that requires complex manipulations is not an adequate solution to the hygiene problem.

A need therefore exists for a sanitary wipe that can be used by a person with limited mobility, yet provides a clean efficient wipe with limited manipulation. This need is met by the present invention as described and claimed below.

SUMMARY OF THE INVENTION

The present invention is a device for wiping a section of the human body surrounding the anus. The device has a contoured body that is shaped to mimic the contours of the anatomy between the anus and groin within the depression between the gluteus muscle groups.

The contoured body has a front edge, a rear edge and two side edges. A ridge is formed on the contoured body. The ridge starts proximate the forward edge and progresses toward the rear edge. The ridge follows an ascending slope to an apex. Additionally, sloped side surfaces ascend from the side edges toward the ridge.

A handle extends laterally from the contoured body. The handle enables the contoured body to be pulled laterally across the body. The contoured body is covered with a disposable wipe. As the wipe moves across the body, it wipes clean the contacted area. The wipe is then removed and thrown away.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention sanitary wipe device can be embodied for either left-handed or right-handed use, the embodiment illustrated shows the sanitary wipe device configured for right-handed use. This embodiment is selected in order to set forth the best mode contemplated for the invention. The illustrated embodiment, however, is merely exemplary and should not be considered a limitation when interpreting the scope of the appended claims.

Figure 1:
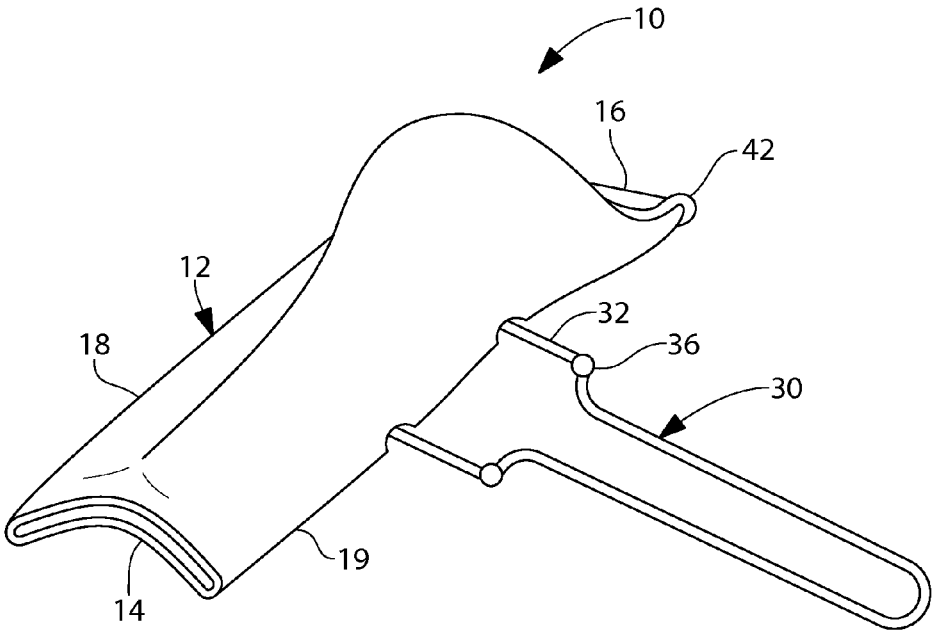
FIG. 1 is a perspective view of an exemplary embodiment of a personal hygiene device.
Figure 2:
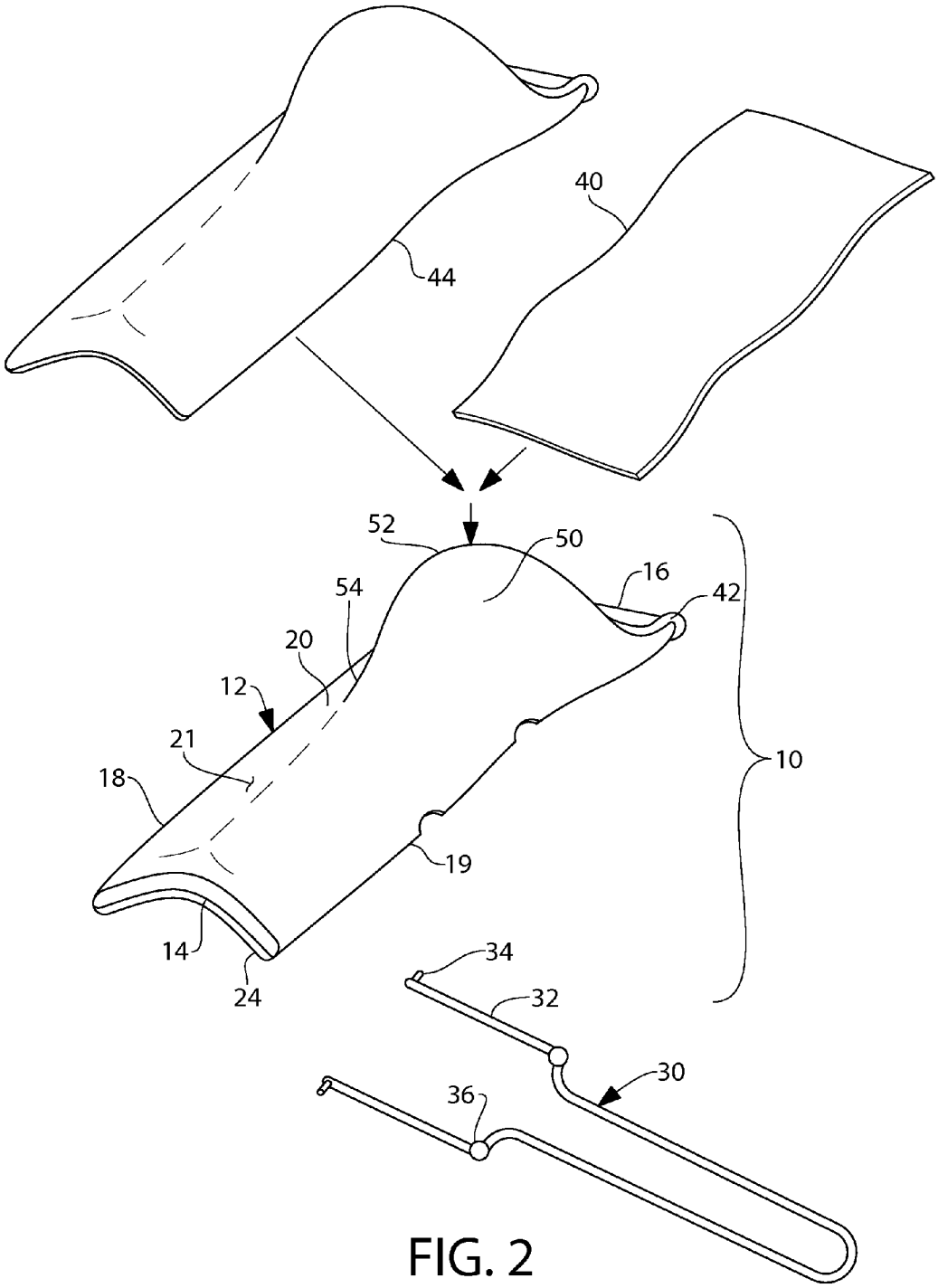
FIG. 2 is an exploded view of the exemplary embodiment of FIG. 1.

Referring to FIG. 1 and FIG. 2, an exemplary embodiment of the present invention personal hygiene device 10 is shown. The personal hygiene device 10 is an assembly of different parts. A contoured body 12 is provided. The contoured body 12 has a front edge 14, a rear edge 16 and two side edges 18, 19 that extend between the front edge 14 and the rear edge 16. As will later be explained in more detail, the contoured body 12 is shaped in a manner that complements the average person's anatomy in the area surrounding the anus.

The contoured body 12 has a top surface 20 that is made of a hydrophobic elastomeric material 21 such as silicone rubber, foam rubber or a styrene-based triblock copolymer. If a foam rubber is used, it is preferred that the foam rubber have a closed cell structure so that the foam rubber cannot absorb liquid.

The contoured body 12 has a complex shape. It is preferred that the distance along the top surface 20 between the two side edges 18, 19 is always equal to or shorter than four inches. (Four inches is the standard width of a roll of toilet paper.) In this manner, should a layer of standard toilet tissue paper be placed atop the contoured body 20, the toilet tissue paper would drape over and cover the entire top surface 20 of the contoured body 12.

A rigid base 24 supports the elastomeric material 21 of the contoured body 12. The rigid base 24 is preferably plastic, but can also be stamped sheet metal, wood or another such material. Receptacles (26 FIG. 3) are formed into the rigid base 24. The receptacles 26 are shaped and positioned to receive and engage a handle 30. The handle 30 terminates with two flexible arms 32. Pegs 34 are formed on the arms that engage the receptacles 26, thereby mechanically joining the handle 30 to the contoured body 12. It can be seen that once the handle 30 is connected to the contoured body 12, the handle 30 extends from the side of the contoured body 12. As such, the handle 30 extends in a direction generally parallel to the front and rear edges 14, 16 of the contoured body 12 and generally perpendicular to the side edges 18, 19 of the contoured body 12. In the shown embodiment, the handle 30 extends from the left side of the contoured body 12 for use by a right-handed person.

The handle 30 may be rigidly formed. However, it is preferred that the handle 30 include at least one hinged adjustment joint 36 that enables the angle of inclination of the handle 30 relative the contoured body 12 to be selectively adjusted.

The personal hygiene device 10 can hold two types of disposable tissue paper. A length of traditional toilet tissue paper 40 can be placed atop the contoured body 12. The toilet tissue paper 40 covers the entire top surface 20 of the contoured body 12. The toilet tissue paper 40 is held in place by a spring clip 42 that is connected to the rear edge 16 of the contoured body 12.

Alternatively, preformed disposable wipes 44 can be provided. The preformed disposable wipes 44 are tissue based, but can be thicker than standard toilet tissue paper. The preformed disposable wipes 44 are preformed into a shape that is complementary to the top surface 20 of the contoured body 12. In this manner, when a preformed disposable wipe 44 is placed atop the contoured body 12, the preformed disposable wipe 44 covers the top surface 20 of the contoured body 12. Again, the preformed disposable wipe 44 is held in place by the spring clip 42 at the rear edge 16 of the contoured body 12.

The spring clip 42 illustrated is merely exemplary of an attachment mechanism capable of holding a sheet of toilet tissue 40 or a preformed disposable wipe 44 in place. Other attachment mechanisms, such as pinch locks and striated holes can also be used.

Figure 3:
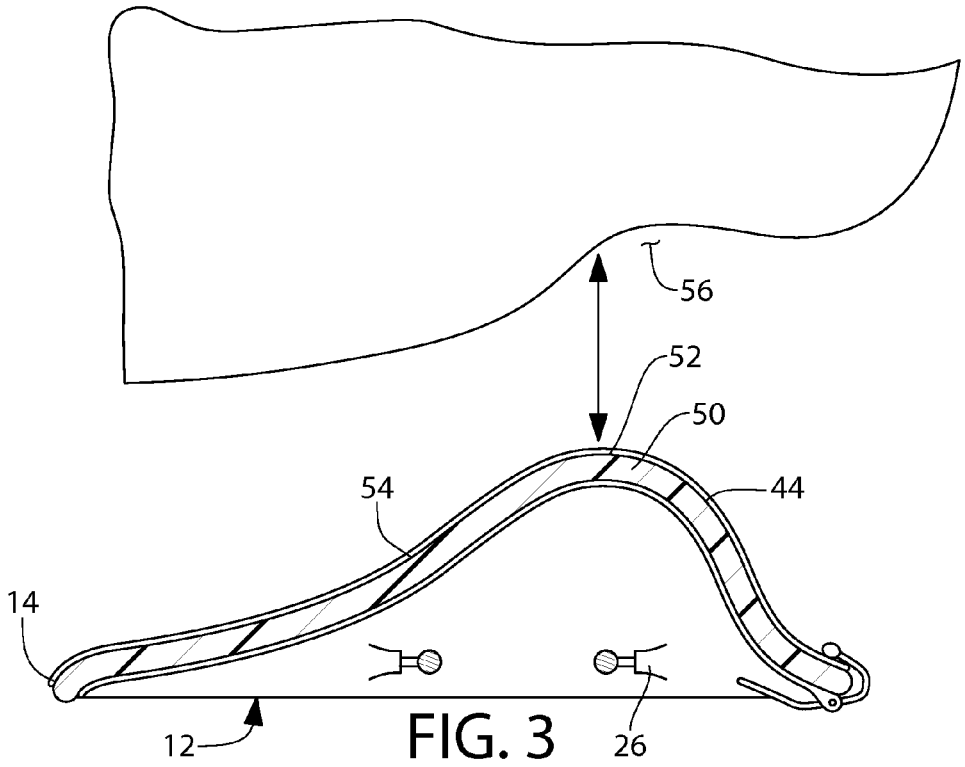
FIG. 3 is a cross-sectional view of the exemplary embodiment shown with a front to back section of a person's posterior.
Figure 4:
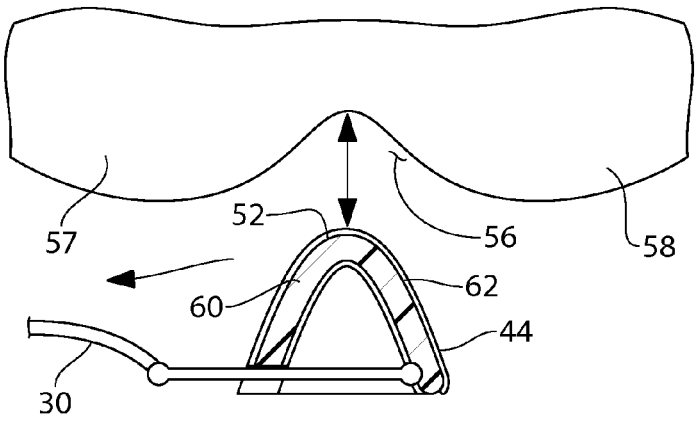
FIG. 4 is a cross-sectional view of the exemplary embodiment shown with a left to right section of a person's posterior.

Referring to FIG. 3 and FIG. 4 in conjunction with FIG. 1, it can be seen that the contoured body 12 embodies a large bump 50 proximate its rear edge 16. The bump 50 has an apex 52. An upwardly ascending ridge 54 extends along the center of the top surface 20 from a point proximate the front edge 14 to the apex 52. The slope of the ridge 54 mimics the anatomical curvature of a person's posterior in the depression 56 between the left and right gluteus muscle groupings 57, 58 between the groin and anus. Furthermore, as is indicated by FIG. 4, two sloped side surfaces 60, 62 ascend from the side edges 18, 19 of the top surface 20 to the ridge 54. The side surfaces 60, 62 form a rounded inverted V-shape. This shape also mimics the anatomical shape of a person's posterior in the depression 56 between the left and right gluteus muscle groups 57, 58.

Referring to all figures, the usage of the personal hygiene device 10 can be explained. To prepare the personal hygiene device 10 for use, a new wipe is placed over the contoured body 12. The wipe can be a length of standard toilet tissue paper 40 or a preformed disposable wipe 44.

Using the handle 30, the wipe is brought into contact with a person's posterior on the far side of the anus. The wipe is then brought into contact with the skin. While maintaining contact with the skin, the wipe is pulled laterally across the area of the anus. Due to the shape of the contoured body 12 under the wipe, the wipe contacts most all surfaces of the anal depression 56 between the gluteus muscle groups 57, 58 during the wiping motion. This creates a full wipe of the entire area with a single stroke. The procedure can be repeated as needed. However, the only manipulation needed of the handle is a simple pulling motion. Once complete, the contaminated wipe is removed and disposed.

The contoured body 12 and handle 30 can be selectively disconnected for easy storage of the device. When disconnected, the handle is preferably sized to fit within the contoured body 12 so that it can be stored in a small space. Likewise both the contoured body 12 and the handle 30 can be periodically laundered by tossing these components into a washing machine with a standard load of laundry.

It will be understood that the embodiment of the present invention that is illustrated and described is merely exemplary and that a person skilled in the art can make many variations to that embodiment. For instance, the shape of the handle can be varied in many ways. Likewise, the shape of the contoured body can be changed to meet the needs of different body types. All such embodiments are intended to be included within the scope of the present invention as defined by the claims.

What is claimed is:

1. A device for wiping a section of the human body surrounding the anus, said device comprising:

a contoured body containing a rigid base layer covered by elastomeric material, said contoured body having a front edge, a rear edge and two side edges, said body defining a ridge that starts proximate said front edge and progresses toward said rear edge, wherein said ridge follows an ascending slope to an apex, and wherein sloped side surfaces ascend from said side edges toward said ridge;

a handle extending from said contoured body; and an attachment mechanism for attaching a disposable wipe over said contoured body.

2. The device according to claim 1, wherein said handle extends out beyond one of said side edges of said contoured body.

3. The device according to claim 1, wherein said handle includes at least one adjustable joint to enable said handle to be selectively angled relative said contoured body.

4. The device according to claim 1, wherein said handle is selectively attachable and detachable from said contoured body.

5. The device according to claim 1, wherein said handle interconnects with said rigid base layer.

6. An assembly for wiping a section of the human body surrounding the anus, said assembly comprising:

a disposable wipe;

a contoured body for supporting said disposable wipe, said contoured body having a rigid base layer covered by elastomeric material, wherein said contoured body contains a ridge that starts proximate a forward edge and progresses toward a rear edge, wherein said ridge follows an ascending slope to an apex, and wherein sloped side surfaces ascend from both sides of said ridge;

a handle extending from said contoured body; and an attachment mechanism for attaching a disposable wipe to said contoured body.

7. The assembly according to claim 6, wherein said wipe is a length of flat toilet tissue paper.

8. The assembly according to claim 6, wherein said wipe is preformed with contours that mimic said contoured body.

9. The assembly according to claim 6, wherein said elastomeric material is disposed in areas that contact said wipe.

10. The assembly according to claim 6, wherein said handle includes at least one adjustable joint to enable said handle to be selectively angled relative said contoured body.

11. The assembly according to claim 6, wherein said handle is selectively detachable from said contoured body.

12. The device according to claim 11, wherein said handle interconnects with said rigid base layer.

* * * * *